US005370362A

United States Patent [19]

Kent et al.

[11] Patent Number: 5,370,362

[45] Date of Patent: Dec. 6, 1994

[54] GATE VALVE

[75] Inventors: Peter M. Kent, Greengates Warthill by Inverurie, Scotland; Anton J. Dach, Houston, Tex.; Hernani G. Deocampo, Houston, Tex.; Ted D. Williams, Houston, Tex.

[73] Assignee: ABB Vetco Gray Inc., Houston, Tex.

[21] Appl. No.: 137,653

[22] Filed: Oct. 15, 1993

[51] Int. Cl.[5] ..... F16K 1/00

[52] U.S. Cl. ..... 251/326; 251/368

[58] Field of Search ..... 251/326, 329, 368

[56] References Cited

U.S. PATENT DOCUMENTS 4,356,838 11/1982 Morello .
4,458,879 7/1984 Jandrasi .
4,911,410 3/1990 Baker .
4,997,162 3/1991 Baker et al. .

*Primary Examiner*—John C. Fox
*Attorney, Agent, or Firm*—James E. Bradley

[57] ABSTRACT

An improved gate for a gate valve will allow shearing of a wireline extending through the gate valve while preserving post-shear seal integrity. The improved gate comprises an inlay of a hard ductile material such as Stellite along the shearing edge of the gate. The gate also comprises a coating of an extremely hard material such as tungsten carbide on the sealing surface of the gate. The invention also covers an improved gate seat. The improved seat also comprises an inlay of a hard ductile material such as Stellite along its shearing edge. The improved seat can also have a coating of an extremely hard material such as tungsten carbide on part of its sealing surface.

16 Claims, 3 Drawing Sheets

GATE VALVE

BACKGROUND OF THE INVENTION

1. Field of the Invention

This invention relates in general to gate valves, and in particular to an improved gate and seat which allows shearing of a wireline while maintaining post-shear seal integrity.

2. Description of the Prior Art

During oil and gas production, wirelines are often lowered through some type of gate valve. Ideally, the wireline is removed from the well before the gate valve is closed. However, due to emergencies, or for other reasons, it sometimes becomes necessary to close the gate valve while the wireline is still located in the well and through the gate valve. In these situations, it is desirable for the gate and seat of the gate valve to be capable of shearing the wireline while retaining post-shear seal integrity.

Also of importance in gate valves used in the oil and gas industry is the durability of the sealing surfaces. Since the valves are opened and closed often, and usually under severe operating conditions, the durability of the sealing surfaces is important to avoid leakage and the necessity of having to frequently perform maintenance on the valves.

In the prior art, two types of coatings are generally used on valve gates. Some gate valves are coated with a layer of very hard material such as a carbide material. This type of coating offers great durability. However, use of this type of coating in valves that might have to shear a wireline is not recommended. This type of coating is generally brittle thereby being inherently subject to chipping. Also, this type of coating is generally thin, averaging between 0.003 inches and 0.005 inches. In this section thickness, this coating is not capable of holding an edge while cutting. Furthermore, since this coating is not metallurgically bonded to the substrate material, high shear stresses are developed at the coating-substrate interface which promote cracking of the coating. Cracking or chipping of the coating is not desirable because it reduces sealing efficiency, thereby requiring replacement of the gate more frequently.

Since coatings of very hard materials such as carbides are not ideal for wireline cutting applications, wireline shearing gates have been typically hardfaced with a hard ductile material such as Stellite or Colmonoy to provide protection against chipping when used for shearing. However, large areas are sometimes difficult to coat with these materials without cracking of the coating. Also, such ductile materials have markedly inferior wear characteristics compared to carbides and are easily scratched or otherwise damaged.

Because of the above problem with coating or hardfacing gates with either only an extremely hard material or only a more ductile material, prior art gate valves have not been suited for shearing wireline while retaining post-shear seal integrity.

SUMMARY OF THE INVENTION

In this invention, the gate of a gate valve is coated with a combination of materials to achieve a gate capable of shearing wireline while retaining seal integrity. Since ductility is desired at the shearing edge of the gate, and extreme hardness is desired at the sealing surfaces of the gate, this invention strategically locates, at appropriate locations, materials having appropriate characteristics.

The shearing edges are constructed of an inlay of a hard ductile material that provides protection against chipping. The sealing surfaces, on the other hand, are coated with an extremely hard material that provides durability to the sealing surface. Although these extremely hard sealing materials are very brittle and would crack and chip if subjected to the high shearing stresses encountered during shearing, this will be prevented by the inlays of the more ductile material located at the shearing edges that will isolate the brittle sealing material from the majority of the shearing stresses.

BRIEF DESCRIPTION OF THE DRAWINGS

The novel features believed characteristic of the invention are set forth in the appended claims. The invention itself however, as well as a preferred mode of use, and further objects and advantages thereof, will best be understood by reference to the following detailed description of an illustrative embodiment when read in conjunction with the accompanying drawings, wherein:

DETAILED DESCRIPTION OF THE INVENTION

Figure 1:
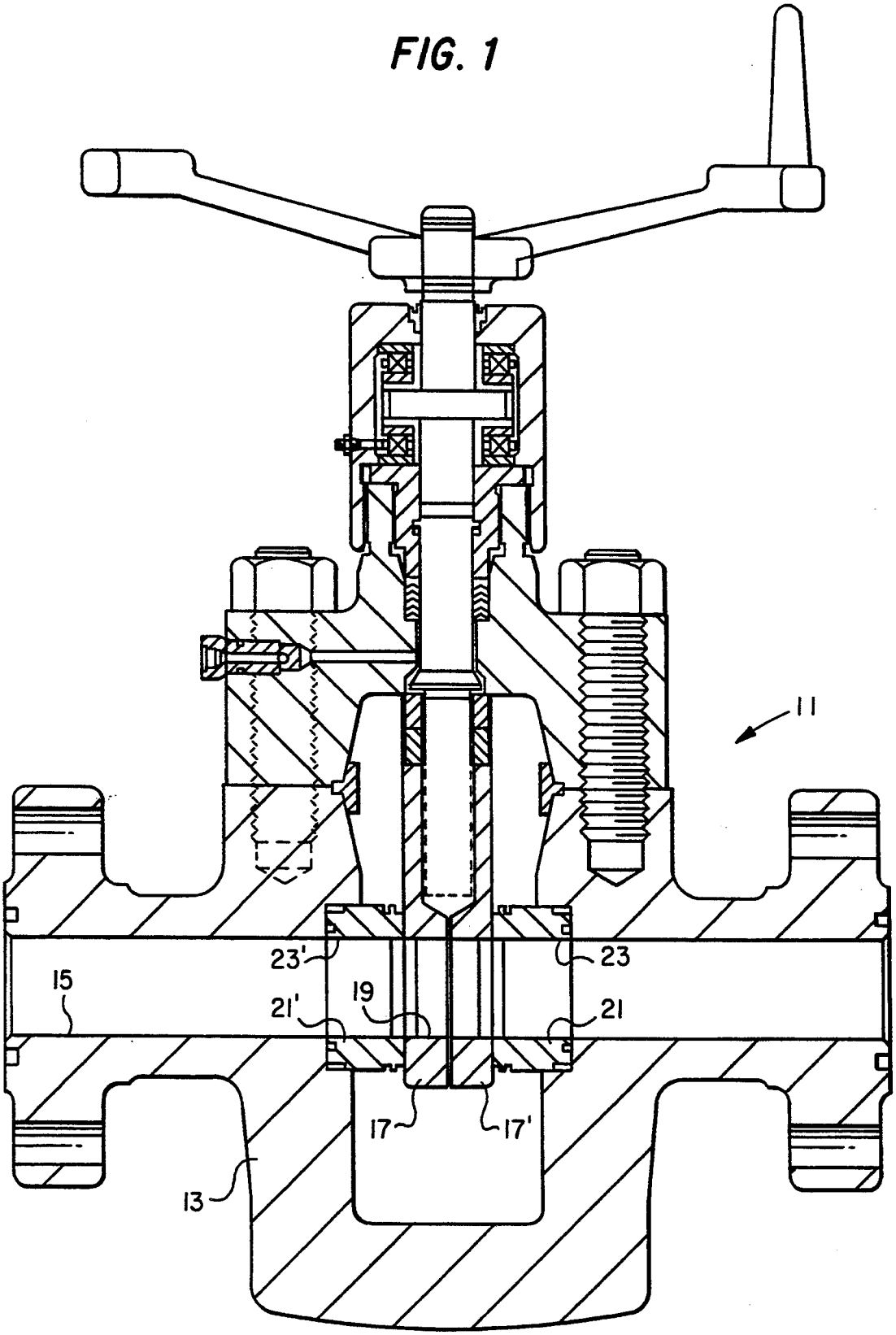
FIG. 1 is a vertical sectional view illustrating a typical gate valve.

Referring to FIG. 1, valve 11 is a standard gate valve. Valve 11 has a body 13, and a flow passage 15 that extends transversely through body 13. Valve 11 has a gate 17 with a hole 19 therethrough. Gate 17 is shown in the open position open and close together. The valve 11 shown in FIG. 1 is a non-rising-stem type valve, however, this invention can similarly be used on rising-stem type valves, in which case the gate 17 would look like the gate 17 shown in FIG. 2. Also shown in FIG. 1 are ring shaped valve seats 21 and 21' which have holes 23 and 23' that register with the flow passage 15 of the valve.

When gate 17 is in the open position, the hole 19 of gate 17 registers with flow passage 15 of the valve 11 thereby allowing flow through the valve. When the gate is closed, the hole 19 no longer registers with the flow passage 15. Instead, the coating 25 (FIG. 2) registers with the flow passage 15 and comes into contact with seat 21.

Figure 2:
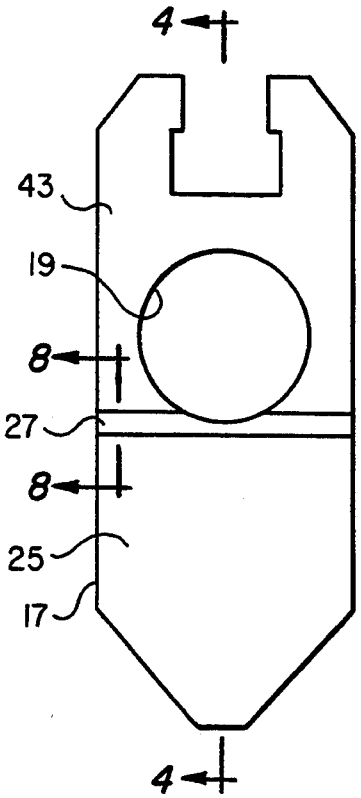
FIG. 2 is a front view of a typical gate, but showing the improvement according to this invention.

FIG. 2 shows gate 17 in more detail. The gate 17 shown in FIG. 2 is for a rising-stem type valve and is therefore configured a little differently than gate 17 shown in FIG. 1.

Gate 17 has some features that are identical except for being located on different sides of gate 17. For convenience, some of the numerals representing such features are followed by the letter "a" or the letter "b". The numerals followed by the letter "a" refer to features located on one side of gate 17, while the same numeral followed by a letter "b" refers to the same feature, but located on the other side of gate 17. For example, Stellite inlay 27*a* refers to the Stellite inlay 27 located on one side of gate 17, while Stellite inlay 27*b* refers to the Stellite inlay 27 located on the other side of gate 17. When one of these numerals is not followed by either the letter "a" or the letter "b", then the reference is to the feature in general, irrespective of the side of gate 17 on which it is located.

According to this invention, gate 17 has an inlay 27 along its shearing edge. Inlay 27 is formed of a hard ductile material. The hardness is desirable to facilitate shearing of a wireline 29 (shown in FIG. 9). The harder the material, the better it will shear the wireline. However, extremely hard materials, such as carbides, are also very brittle. Brittleness is not desired because chipping occurs thereby reducing the sealing capability of the gate. Some ductility is desirable because it prevents chipping. The preferred embodiment of the invention uses Stellite. Stellite is a hard ductile material. It is hard enough to allow shearing of the wireline, but is more ductile than carbide materials, thereby preventing chipping.

The inlay 27 of Stellite is applied to gate 17 as shown in FIGS. 8A–8D. Before drilling hole 19 (shown in FIG. 2), a groove 31 is machined into gate 17. The groove 31 extends from one side of gate 17 to the other side of gate 17 and intersects what will later become hole 19. Still referring to FIGS. 8A–8D, groove 31 has a bottom surface 33, and an inclined surface 35. Inclined surface 35 can be either perpendicular to bottom surface 33, thereby creating a 90 degree angle between the bottom surface and the inclined surface, or it can be inclined at some other angle, such as the 45 degree angle shown in FIG. 8A. Groove 31 extends from one side of gate 17 to the other side of gate 17 for ease of manufacture. The groove 31 could have a different configuration as long as it allows a shearing edge to be formed around at least a portion of hole 19.

Figure 3:
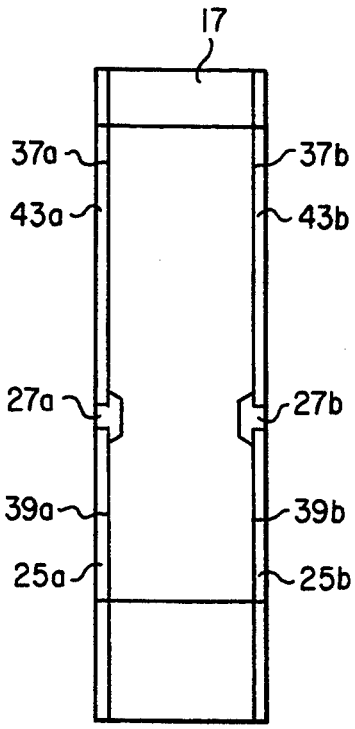
FIG. 3 is a side view of the gate shown in FIG. 2.
Figure 8A:
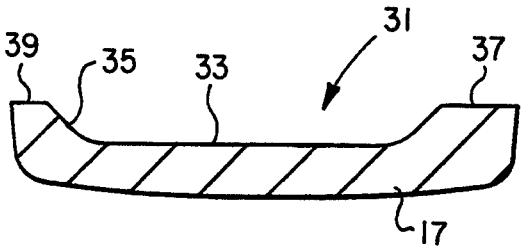
FIGS. 8A–8D are parts of a sectional view taken along the line 8—8 in FIG. 1 and showing the steps used in connecting the inlay to the gate.
Figure 8B:
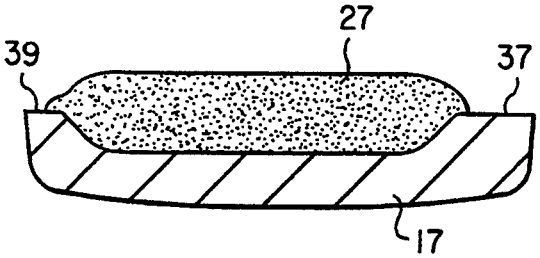

After groove 31 is machined into gate 17, groove 31 is welded full with Stellite to form inlay 27. The welding process results in the Stellite protruding above surfaces 37 and 39 of gate 17, as shown in FIG. 8B. As shown in FIG. 3, surface 37 is the surface along the face of gate 17 that extends from the groove towards the portion of the gate where hole 17 is located. Surface 39 is the surface on the face of gate 17 that extends from the groove towards the sealing portion of gate 17. Surfaces 37 and 39 are the surfaces which are later coated with the very hard material.

Figure 8C:
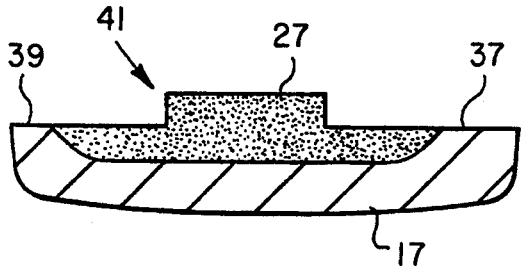
Figure 8D:
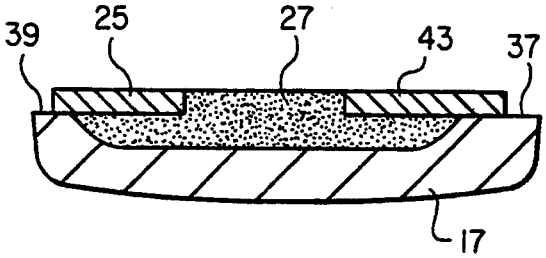

Referring again to FIG. 8, the inlay 27 is then ground down to leave a rectangular notch 41 of Stellite protruding above surfaces 37 and 39, as shown in FIG. 8C. The Stellite around the rectangular notch 41 is ground down flush with the surfaces 37 and 39 of gate 17, as shown in FIG. 8C.

Before the extremely hard coatings are applied to the gate, hole 19 is drilled into gate 17 as shown in FIG. 2. Once hole 19 has been drilled and inlay 27 has been prepared as described above, surfaces 37 and 39, and the portions of inlay 27 that have been ground flush with surfaces 37 and 39 can be coated with an extremely hard material such as tungsten carbide. The coating deposited on surface 39 will be referred to as coating 25, while the coating deposited on surface 37 will be referred to as coating 43. Coatings 25 and 43 are deposited by a conventional high energy deposition technique such as Praxair's LW-45. The coating 25, deposited onto surface 39 and the portion of inlay 27 that is flush with surface 39, will form the sealing surface that will contact against seat 21. During opening and closing of the valve, coating 25 is subject to scratching and other damage which must be prevented if the seal integrity of the valve is to be preserved. Therefore, it is desirable for coating 25 to be very durable. Because tungsten carbide is an extremely hard material, it affords great durability.

In the preferred embodiment, both surfaces 37 and 39 are coated with tungsten carbide. However, since surface 37 does not perform any sealing functions, it need not be coated. In the case that surface 37 is not coated, then surface 37 should be made to be flush with coating 25 on surface 39 and flush with the rectangular notch 41 of inlay 27.

Figure 4:
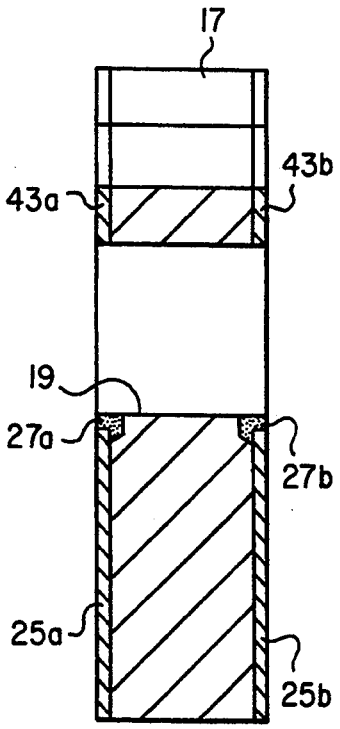
FIG. 4 is a vertical sectional view of the gate shown in FIG. 1 taken along the line 4—4 in FIG. 2.
Figure 5:
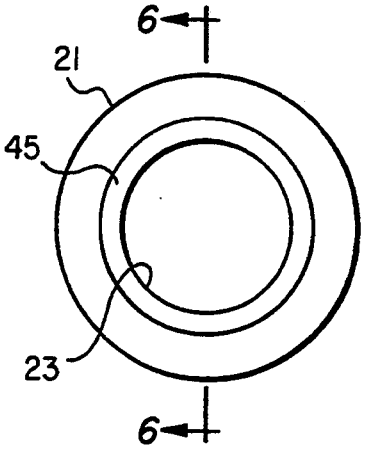
FIG. 5 is a front view of a typical seat, but showing the improvement according to this invention.

The above process will result in the shearing edge of hole 19 having reinforcements of Stellite as shown in FIG. 4. Hole 19 has a circular opening at each end of the hole. The intersection of the opening of hole 19 and of surfaces 37*a* and 39*a* define a circumference. The above process results in a Stellite shearing edge along at least a portion of this circumference. Since only a portion of this circumference acts as a shearing edge, only that portion of the circumference needs to have the Stellite shearing edge. However, the Stellite shearing edge can extend completely around the circumference.

The above description discussed improving only one side of gate 17. This would be the case where valve 11 is of a type that uses two physically separated gates working in unison as illustrated in FIG. 1. In such a case, only one side of each gate would need to be improved. Each gate would have a sealing surface and a back surface. The sealing surface would be improved with Stellite inlay 27 and tungsten carbide coatings 43 and 25. The back surface would be left in its natural state, since it performs no sealing functions.

However, in a valve that uses only one gate, both the sealing surface and the back surface would be sealing surfaces, and both would need to be improved with Stellite inlay 27*a* and 27*b* and tungsten carbide coatings 43*a*, 43*b*, 25*a*, and 25*b*.

In the preferred embodiment of this invention, seats 21 have an inlay 45 of a hard ductile material that forms a shearing edge. The hardness is desirable to facilitate shearing of the wireline. The harder the material, the better it will shear the wireline. However, some of the very hard materials are also very brittle. Brittleness is not desired because chipping occurs thereby reducing the sealing capability of the seat. Some ductility is desirable because it prevents chipping. The preferred embodiment of the invention uses Stellite for inlay 45.

Figure 6:
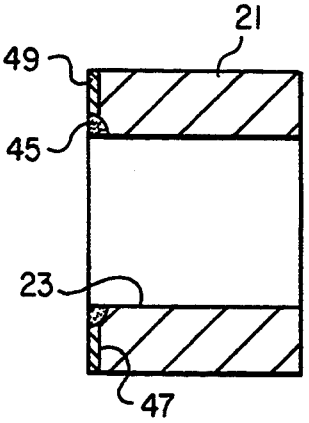
FIG. 6 is a vertical sectional view of the seat shown in FIG. 5 taken along the line 6—6 in FIG. 5.

In the preferred embodiment, inlay 45 is applied to seat 21 by a process similar to the process used for applying inlay 27 to gate 17. Referring to FIG. 6, a groove is machined into the circumference defined by the intersection of hole 23 and of sealing surface 47 of the seat 21. The Stellite inlay 45 is then welded into the groove and machined to remove the excess portions of inlay 45. The remainder of surface 47 is then coated with a coating 49 of an extremely hard material such as tungsten carbide. The coating 49 is deposited so that coating 49 and the outward surface of the inlay 45 are flush, thereby providing a smooth sealing surface. Tungsten carbide is an extremely hard material that affords great durability. Since the coating 49 deposited onto surface 47 will form the sealing surface that will contact against the sealing surface of gate 17, this coating needs to be very durable to preserve the integrity of the seal. Tungsten carbide provides such durability.

Figure 7:
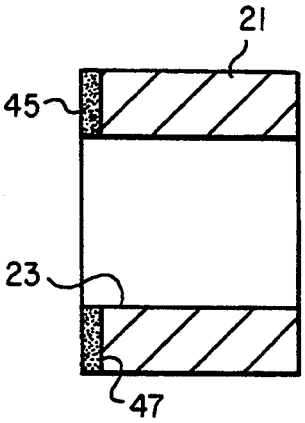
FIG. 7 is the same sectional view shown in FIG. 6, but showing a different arrangement of the inlay and the coating of the seat.

Although the seat described above has both Stellite inlay 45 and tungsten carbide coating 49, it would also be feasible to use only a Stellite inlay 45 that extends across the entire surface 47 of seat 21, as shown in FIG. 7.

The desired thicknesses in the preferred embodiment for inlays 27 and 45 and for coatings 25, 43, and 49 are as follows. After grinding, the Stellite inlays 27 and 45 should preferably be about 0.080 inches. However, thicknesses between 0.060 inches and 0.100 inches have also been found to be acceptable. Thicker inlays should also be theoretically acceptable, however, most of the processes used to apply the Stellite to the gate limit the maximum thickness to about 0.100 inches. The preferable thickness of carbide coatings 25, 43, and 49 is 0.005 inches. However, thicknesses between 0.003 inches and 0.006 inches have also been found to be acceptable.

As described above, the preferred embodiment uses Stellite for inlays 27 and 45 and tungsten carbide for coatings 25, 43, and 49. However, different materials, having similar characteristics could also be used. The following criteria should be used in selecting appropriate materials. The material used for coatings 25, 43 and 49 should be a very hard, wear resistant material. The preferred embodiment uses tungsten carbide for coating 25, 43, and 49. The hardness of the tungsten carbide coatings of the preferred embodiment is in excess of 65 on the Rockwell C hardness scale. Such hardness is sufficient to provide a wear resistant sealing surface that is not easily scratched.

The material for inlays 27 and 45 should be a hard material that is relatively ductile when compared to the material used for coatings 25, 43 and 49. The material selected for inlays 27 and 45 must be sufficiently hard to allow shearing of a wireline extending through the valve 11, and must also be sufficiently ductile so that a small deformation will not cause fracture of the material. The preferred embodiment uses Stellite for inlays 27 and 45. The hardness of the Stellite used in the preferred embodiment is in the range of about 40 to 50 on the Rockwell C hardness scale. This hardness is sufficient to allow shearing of a wireline. However, Stellite was also selected for the preferred embodiment because it is relatively ductile when compared to the material used for coatings 25, 43 and 49, and will not chip or fracture when subjected to the deformations caused during shearing of a wireline.

Figure 9:
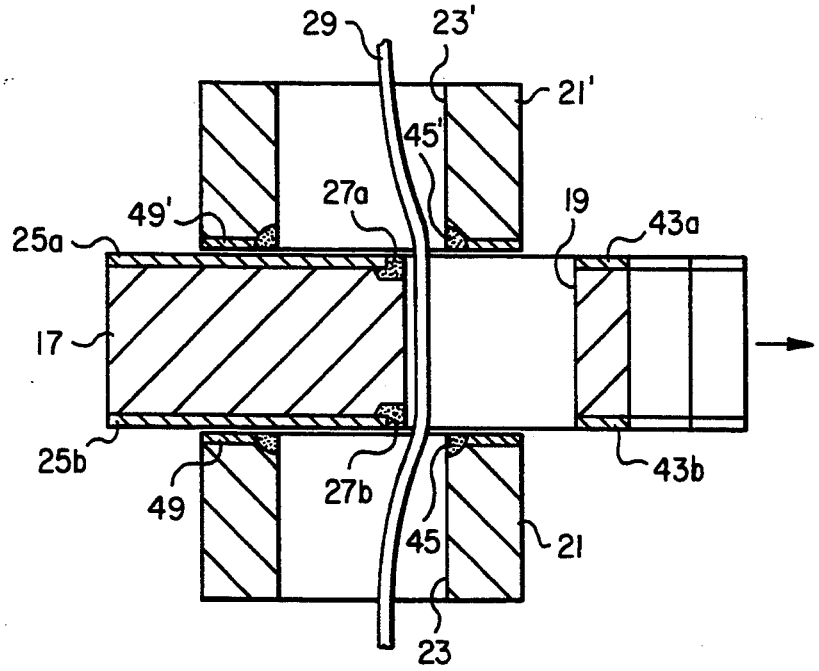
FIG. 9 is a cross sectional view of the gate of FIG. 2 and of the seat of FIG. 5 showing the shearing of a wireline.

Referring now to FIG. 9, wireline 29 is shown extending through seat 21', gate 17, and seat 21. Gate 17 is shown in a nearly closed position. If gate 17 were in its open position, hole 19 would be aligned with the flow passages defined by holes 23 and 23' of seats 21 and 21'. If gate 17 were in its closed position, then coatings **25*a* and 25*b* would be completely obstructing the flow passage defined by holes 23 and 23'. As shown in FIG. 9, gate 17** is moving from its open position to its closed position as indicated by the arrow.

As gate 17 continues its movement from the open position to the closed position, wireline 29 will eventually come into contact with inlay **27*a* on gate 17 and with inlay 45' on seat 21'. Wireline 29 will also eventually come into contact with inlay 27*b* on gate 17 and with inlay 45 on seat 21. As increasing force is applied to gate 17, there will be a shearing action between inlay 27*a* and inlay 45' and between inlay 27*b* and inlay 45. This shearing action will result in the shearing of wireline 29. Once wireline 29 is sheared, gate 17** will be able to continue to its closed position.

Once the gate is in its closed position, and assuming that pressure is higher at seat 21 than at seat 21', then coating **25*a* will come into contact with coating 49', and possibly inlay 45', thereby creating a seal that will prevent flow through the valve 11**.

Since the shearing edges are formed by Stellite inlays 27 and 45, the shear stresses will mainly be born by those edges, thereby insulating the carbide coatings 25 and 49 from the high shear stresses developed by the shearing of the wireline. Since coatings 25 and 49 will not have encountered the high shearing stresses, chipping of those coatings will not occur, and the sealing integrity of the seal will have been preserved.

While the invention has been particularly shown and described with reference to a preferred embodiment, it will be understood by those skilled in the art that various changes in form and detail may be made therein without departing from the spirit and scope of the invention.

What is claimed is:

1. In a gate valve comprising a body, a flow passage, at least one gate having a hole therethrough which registers with the flow passage when the gate is in an open position, and at least one seat located in the flow passage and to which the gate seals when in a closed position, the gate comprising in combination:

a shearing edge located on an edge of the hole for shearing a wireline in the flow passage, the shearing edge being formed of a material harder than the gate; and the gate having a sealing surface that slidably engages the seat as the gate moves to the closed position, the sealing surface being a coating of material having more hardness than the material of the shearing edge.

2. A gate valve according to claim 1 wherein the seat further comprises a shearing edge made of a material harder than the material of the gate.

3. A gate valve according to claim 1 wherein the seat further comprises a shearing edge made of a material harder than the material of the gate, and a sealing surface made of a material having more hardness then the material of the shearing edge.

4. The gate valve according to claim 1 wherein the material of the shearing surface is Stellite.

5. The gate valve according to claim 1 wherein the material of the sealing surface is tungsten carbide.

6. In a gate valve comprising a body, a flow passage, at least one steel gate having a hole therethrough which registers with the flow passage when the gate is in an open position, and at least one seat located in the flow passage and to which the gate seals when in a closed position, the gate comprising in combination:

a flat sealing surface on one side of the gate for slidingly engaging the seat, the sealing surface comprising a carbide coating;

a flat back surface on an opposite side of the gate that is parallel to the sealing surface;

the hole having a first circular opening intersecting the sealing surface and a second circular opening intersecting the back surface;

the first circular opening defining a first circumference and the second circular opening defining a second circumference; and a shearing portion made of a shearing material harder than steel and more ductile than the carbide coating of the sealing surface located at least partially around the first circumference for shearing in the event of an emergency a wireline extending through the flow passage.

7. The gate valve according to claim 6 wherein the shearing material is Stellite.

8. The gate valve according to claim 6 wherein the carbide coating is tungsten carbide.

9. The gate valve according to claim 6 wherein the seat comprises a shearing edge made of a material harder than steel and more ductile than tungsten carbide.

10. The gate valve according to claim 6 wherein the seat additionally comprises a carbide coating located on at least part of a portion contacted by the gate.

11. The gate valve according to claim 6 wherein the shearing portion is located on both the first circumference and the second circumference.

12. In a gate valve comprising a body, a flow passage, at least one gate having a hole therethrough which registers with the flow passage when the gate is in an open position, and at least one seat located in the flow passage and to which the gate seals when in a closed position, the gate comprising in combination:

a flat sealing surface on one side of the gate for slidingly engaging the seat, the sealing surface comprising a carbide coating;

a flat back surface on an opposite side of the gate that is parallel to the sealing surface, the back surface comprising a carbide coating;

the hole having a first circular opening intersecting the sealing surface and a second circular opening intersecting the back surface;

a first groove across the sealing surface intersecting the first circular opening;

a second groove across the back surface intersecting the second circular opening; and an inlay in both the first and second groove of a shearing material harder than steel and more ductile than the carbide coating of the sealing surface.

13. The gate valve according to claim 12 wherein the shearing material is Stellite.

14. The gate valve according to claim 12 wherein the carbide coating is tungsten carbide.

15. The gate valve according to claim 12 wherein the seat comprises a shearing edge made of a material harder than steel and more ductile than tungsten carbide.

16. The gate valve according to claim 12 wherein the seat additionally comprises a carbide coating located on at least part of a portion contacted by the gate.

* * * * *

UNITED STATES PATENT AND TRADEMARK OFFICE

CERTIFICATE OF CORRECTION

PATENT NO. : 5,370,362

DATED : December 6, 1994

INVENTOR(S) : Peter M. Kent, et al.

It is certified that error appears in the above-indentified patent and that said Letters Patent is hereby corrected as shown below:

At column 2, line 49, after "therethrough." insert --The gate 17 can be either split as shown or it can be a single slab.--

At column 2, line 50, "position" should be --position.--

At column 2, line 50, after "position." insert --Of course, both halves must"--

Signed and Sealed this

Sixteenth Day of May, 1995

*Attest:*

Bruce Lehman

BRUCE LEHMAN

*Attesting Officer*

*Commissioner of Patents and Trademarks*